US005238539A

United States Patent [19]

Baird

[11] Patent Number: 5,238,539

[45] Date of Patent: Aug. 24, 1993

[54] COKE OVEN DOOR

[75] Inventor: Billy C. Baird, Sturgis, Ky.

[73] Assignee: Saturn Machine & Welding Co., Inc., Sturgis, Ky.

[21] Appl. No.: 870,551

[22] Filed: Apr. 17, 1992

Related U.S. Application Data

[63] Continuation-in-part of Ser. No. 808,960, Dec. 13, 1991, which is a continuation of Ser. No. 700,031, May 7, 1991, abandoned, which is a continuation of Ser. No. 82,205, Aug. 6, 1987, abandoned.

[51] Int. Cl.[5] ..... C10B 25/06

[52] U.S. Cl. ..... 202/248; 202/268

[58] Field of Search ..... 202/248, 242, 268, 247; 110/173 R

[56] References Cited

U.S. PATENT DOCUMENTS

| | | | |
|---|---|---|---|
| 890,175 | 6/1908 | Ries | 202/248 |
| 2,606,865 | 8/1952 | Forsans | 202/248 |
| 4,186,055 | 1/1980 | Baird et al. | 202/248 |
| 4,263,101 | 4/1981 | Thiersch et al. | 202/248 |
| 4,532,010 | 7/1985 | Durslen et al. | 202/248 |
| 4,919,764 | 4/1990 | Baird et al. | 202/248 |

FOREIGN PATENT DOCUMENTS

| | | | |
|---|---|---|---|
| 17748 | of 1912 | United Kingdom | 202/248 |
| 1417207 | 12/1975 | United Kingdom . | |

*Primary Examiner*—Joye L. Woodard

*Attorney, Agent, or Firm*—Wood, Herron & Evans

[57] ABSTRACT

A coke oven door has a mainframe, a diaphragm plate mounted on the mainframe, a seal mounted peripherally on the diaphragm plate, and plungers mounted peripherally on the mainframe for applying adjusting force to the seal. The seal is adapted for angular contact with a door jamb, and is backed by individual leaf springs arranged in end-to-end relation which are operable to provide rigidity to the seal when the seal is in contact with the jamb. The seal is locally adjustable with the plungers. The mainframe includes a pair of generally parallel side plates having slots along their lengths and a turnbuckle spanning each slot. The turnbuckles provide for flexing the mainframe into a desired configuration for initial adjustment of the door to a door jamb.

7 Claims, 3 Drawing Sheets

COKE OVEN DOOR

RELATED APPLICATIONS

This application is a continuation-in-part of application Ser. No. 07/808,960 filed Dec. 13, 1991, which is a continuation of application Ser. No. 07/700,031 filed May 7, 1991, now abandoned, which is in turn a continuation of application Ser. No. 07/082,205 filed Aug. 6, 1987, now abandoned.

FIELD OF THE INVENTION

This invention relates generally to coke oven doors, and more particularly to a coke oven door and seal of an improved construction for effecting a proper seal with the door jamb of a coke oven.

BACKGROUND OF THE INVENTION

Coke oven doors in use today are of various constructions and include various types of sealing structures for effecting a seal between the oven door and the jamb of a coke oven. One type of door utilizes a relatively rigid door frame to which is peripherally mounted a seal in the form of a metal strip, a knife edge of which contacts the door jamb sealing surface generally perpendicularly for sealing therewith.

In use, the door jamb of a conventional coke oven tends to become warped or distorted due to the extreme temperatures to which the jamb is subjected during the coking process. In addition, the coking process generates a hard carbon deposit, which deposit tends to coat the door jamb sealing surface creating irregularities around its periphery.

A disadvantage of conventional coke oven doors is the lack of any provision with which to adjust the overall contour of the door to provide for proper sealing of the door with the door jamb when the jamb has become warped or distorted.

Another disadvantage of coke oven doors of previous designs are their sealing structures inability to compensate for hard carbon deposit, generated by the firing of the coke oven, which has coated the door jamb. Such accumulation of deposit on the door jamb creates irregularities around the periphery of the jamb sealing surface and prevents the knife edge of the typical coke oven door seal from effecting a complete seal around the periphery of the door jamb.

One attempt at providing adjustment force to a sealing edge is disclosed in U.S. Pat. No. 4,186,055, assigned to the assignee of the instant application. In that patent, there is disclosed the use of a pair of plates 68 adjustably mounted through the use of a slot 70 and pins 72 for varying the amount of tension on the resilient middle portion of a diaphragm.

Another attempt at providing for sealing edge adjustment is disclosed in U.S. Pat. No. 4,263,101 to Thiersch et al. In the Thiersch patent, there is disclosed a plurality of door body elements hingedly connected together. Each individual door body element is rotatably disposed at its top and bottom around a horizontal axle extending transversely of the height of the coke oven door. Such a door, however, is subject to criticism as the pivoted connections of the numerous door bodies provide for too much relative movement therebetween, the pivoted joints lacking enough flexural rigidity to be properly adjustable.

It is therefore an objective of the present invention to provide an improved coke oven door and sealing structure which can compensate for warped and distorted jambs and which can accommodate irregularities in the jamb surface due to deposits thereon such that a proper seal can be effected between door and jamb.

SUMMARY OF THE INVENTION

These objectives are achieved by the coke oven door of the present invention which has a main frame, a diaphragm plate mounted on the main frame, a seal mounted peripherally on the diaphragm plate, and plungers mounted peripherally on the main frame for adjustably applying force to the seal.

The seal is adapted for angular contact with a door jamb, and is backed by a plurality of leaf springs arranged in end-to-end relation and which are operative to provide rigidity to the seal when the seal is in contact with the door jamb. The seal provides flexibility around the periphery of a door jamb, and is locally and individually adjustable with the plungers to force the seal into contact with the jamb. The seal is thereby able to accommodate irregularities around the periphery of a door jamb without compromising the integrity of the door to jamb seal.

To provide adjustment to the overall coke oven door, the main frame includes a planar base plate means and a pair of generally parallel side plates connected to the base plate means and spaced from one another transversely of the horizontal extent of the door. The side plates include slots spaced along their lengths and extending from an edge remote from the base plate toward the base plate and only partially through the side plates. These slots provide flexibility to the side plates and hence to the main frame. A turn buckle spans each slot in each side plate and provides for flexing the main frame into a desired configuration.

One advantage of the present invention is that a coke oven door is provided with a seal which is readily adaptable to and conformable with an irregular coke oven door jamb and which includes individual adjustment of the seal around the entire periphery of the door.

Another advantage of the present invention is that a coke oven door is provided which has an adjustable overall flexibility which can be selectively adjusted to flex the entire door into a desired configuration for mating and effective sealing with a warped or distorted door jamb.

These and other objects and advantages of the present invention will become more readily apparent during the following detailed description taken in conjunction with the drawings herein in which:

DESCRIPTION OF PREFERRED EMBODIMENT

Figure 1:
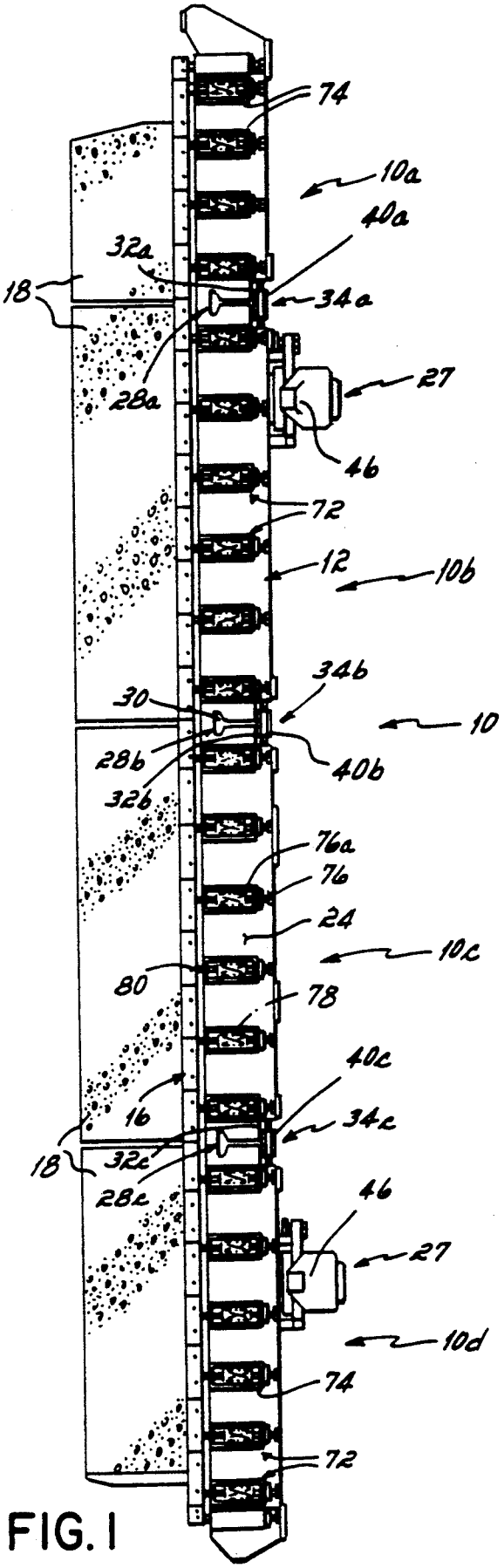
FIG. 1 is a side plan view of the coke oven door of the present invention.
Figure 2:
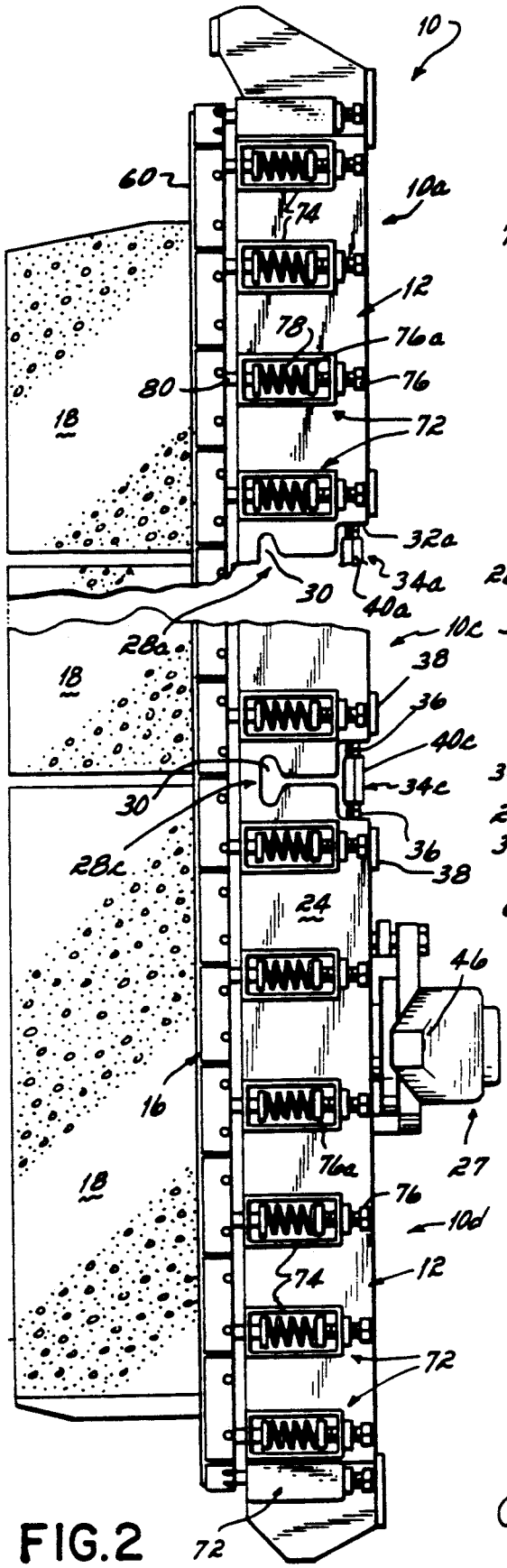
FIG. 2 is an enlarged, broken side plan view of the coke oven door of FIG. 1.
Figure 3:
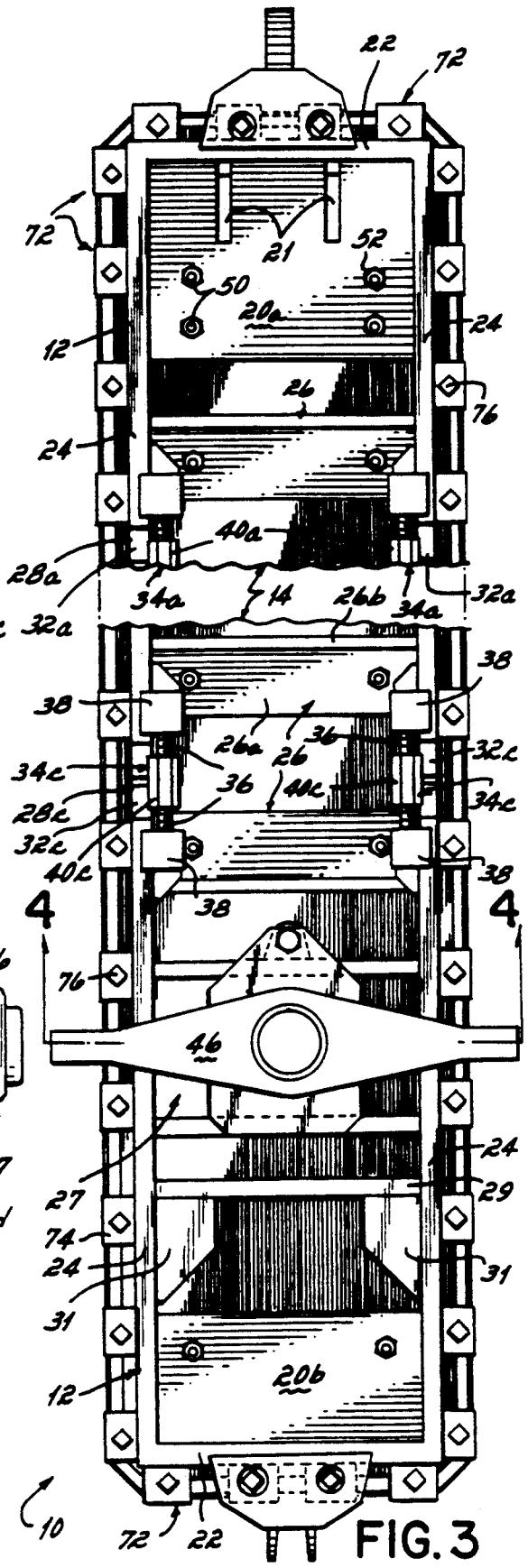
FIG. 3 is a front plan view of the door of FIG. 2.

With reference to the drawings, and in particular first to FIGS. 1-3, there is illustrated the coke oven door 10 of the present invention. The door 10 includes, generally, a main frame 12, a diaphragm plate 14 secured to the main frame 12, a seal assembly 16 mounted on the periphery of the diaphragm plate 14 and a plurality of refractories 18 secured to the diaphragm plate 14 and main frame 12.

The main frame 12 has base plates 20*a* and 20*b* located at the top and bottom of the door 10, to which are attached a pair of generally parallel end plates 22, 22 spaced from one another vertically of a vertical extent of the door 10, and a pair of side plates 24, 24 spaced from one another transversely of a horizontal extent of the door 10. The plates 22, 22 and plates 24, 24 are fixedly secured to the base plates 20*a* and 20*b*, as by welding, and are generally perpendicular thereto. Gussets 21 are fixedly secured to the upper end 22 and the base plate 20*a*. The main frame 12 includes a plurality of transversely oriented vertically spaced structural angle stiffeners 26 fixedly secured to the plates 24, 24. Each stiffener 26 includes one leg 26*a* which lies in the same plane as the base plates 20*a* and 20*b* and another leg 26*b* which is substantially perpendicular to the leg 26*a*.

Figure 4:
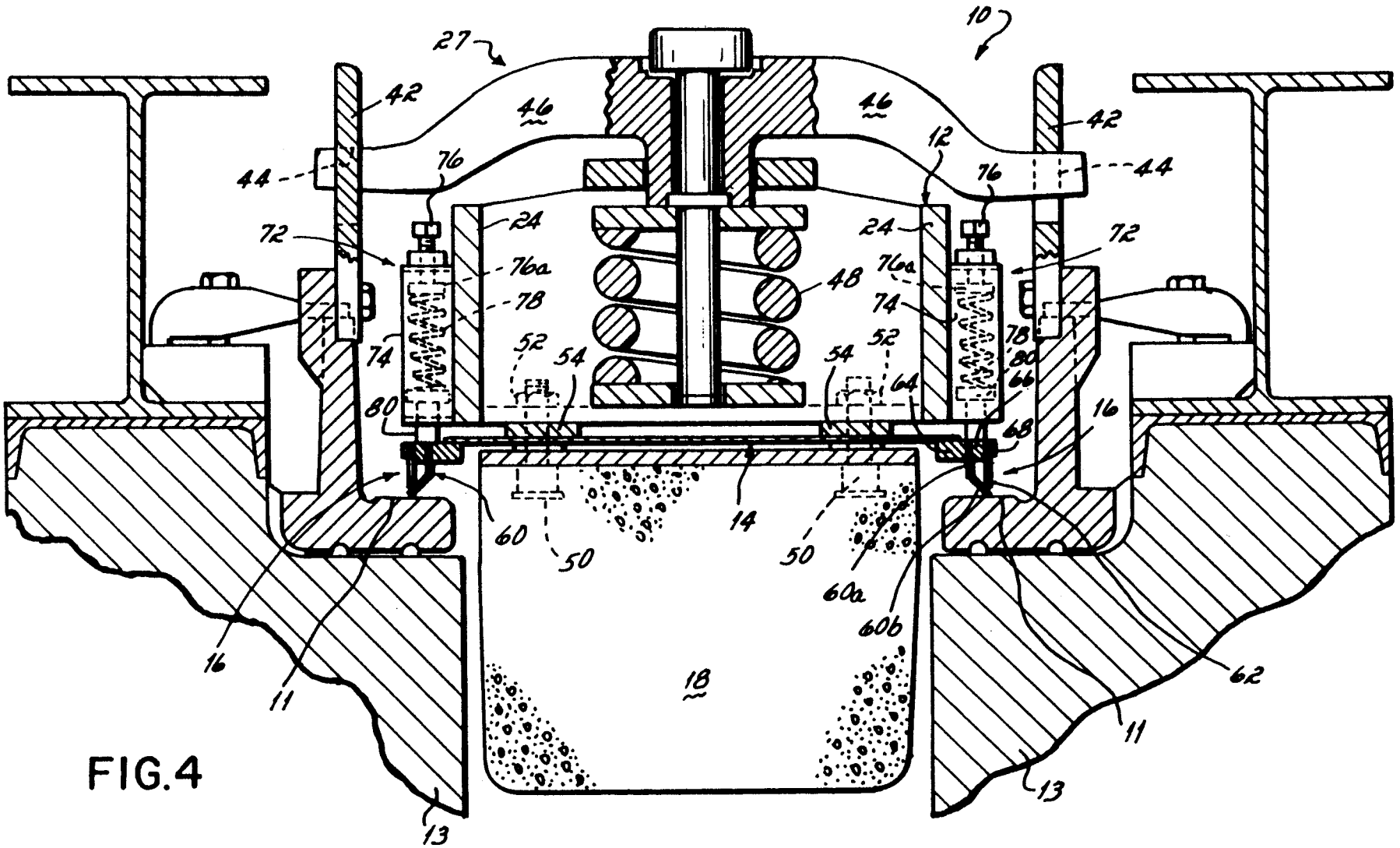
FIG. 4 is a view taken along lines 4—4 of FIG. 3.

The main frame 12 further includes a pair of conventional locking devices 27, 27 for locking the coke oven door 10 onto a door jamb 11 of a coke oven 13 (FIG. 4). A transversely oriented stiffener 29 is affixed to the plates 24, 24 immediately below each locking device 27, 27 (only one of which is shown, FIG. 3). A pair of gussets 31, 31 tie the stiffener 29 to the plates 24, 24. As can be seen from FIG. 4, locks 27, 27 act to lock door 10 to jamb 11 of oven 13 by a pair of brackets 42, 42 each provided with a respective notch 44 extending in the direction opposite the other of the notches for receiving respective ones of the ends of locking arms 46 rotatably mounted for pivotal movement between a position engaging in notches 44 and a position clear of notches 44. The former is the locked mode, reached by rotation of locking arms or latch bars 46, and the latter is the unlocked mode of each of the locks 27, 27. A suitable compression spring 48, and the like, is associated with each of the locks 27, 27.

With reference to FIGS. 1–3, it will be seen that each side plate 24 includes three slots 28*a*, 28*b* and 28*c* spaced along the length of the side plate 24 from an edge remote from the base plates 20*a* and 20*b* and diaphragm plate 14 toward the base plates 20*a* and 20*b* and diaphragm plate 14 and extending only partially through the side plate 24 generally transversely to its length. Each of the slots 28*a–c* includes at its bottom a relieved area 30 which is substantially wider than a width dimension associated with each slot 28*a–c* to minimize any stress concentrations thereat. At the other end or top of the slots 28*a–c* there are gaps 32*a*, 32*b* and 32*c*, respectively, to provide for accessibility to adjusting mechanisms 34*a*, 34*b* and 34*c*, respectively, which may be utilized to adjust the overall contour or curvature of the door 10 to provide for proper sealing of the door 10 with a door jamb 11 which has become warped or distorted, the adjustment of which will be subsequently described. Of course, each side plate 24 could employ more than three slots if, for example, a longer door is used.

Each of the adjusting devices 34*a–c* includes a pair of threaded studs 36, 36. A threaded stud 36 is secured on each side of each of the gaps 32*a–c* to a mounting block 38 which is fixedly secured to the side plate 24. Threaded turnbuckles 40*a*, 40*b* and 40*c* span the slots 28*a–c*, respectively, and are threadably connected on their ends to their respective threaded studs 36, 36. It will be appreciated that the door 10 is divided into four door segments 10*a*, 10*b*, 10*c* and 10*d* via the individual refractories 18 and slots 28*a–c* in the side plates 24, 24 of main frame 12. Of course, a longer door may have a greater number of door segments.

Referring now to FIG. 4, refractories 18 are secured to the main frame 12 via a plurality of bolts 50 which pass through the diaphragm plate 14 and the base plates 20*a* and 20*b* and the legs 26*a* of the stiffeners 26 of the main frame 12. Nuts 52 secure the refractories 18 to the bolts 50. Hanger bars 54 are disposed between the diaphragm plate 14 and the base plates 20*a* and 20*b* and the legs 26*a* of the stiffeners 26 of the main frame 12 and allow for flexure of the main frame 12 upon adjustment of the adjusting devices 34*a–c*, and additionally carry the weight of the refractories 18. Nuts 52 and bolts 50 securely clamp plate 20*a*, hanger bars 54, diaphragm plate 14 and refractory 18 together. Legs 26*a* of stiffeners 26 and plate 20*b* include within slotted bolt holes a spacer bushing (not shown) which is slightly thicker than the thickness of legs 26*a* and plate 20*b*, such that when their respective nuts 52 and bolts 50 are tightened there is a slight amount of play to accommodate for thermal expansion and contraction.

The seal assembly 16 includes an Inconel seal 60 spanning the periphery of the door 10 and having a first leg 60*a* which is disposed generally perpendicularly to the jamb 11, and a second leg 60*b* which is angled peripherally outwardly and which contacts the jamb 11 at an angle. Of course, other materials besides Inconel may be utilized, for example, stainless steel. A plurality of individual leaf springs 62 are spaced around the periphery of the door 10 in end-to-end relation and back the Inconel seal 60, and are oriented generally perpendicularly to the door jamb 11. Each individual leaf spring 62 contacts the Inconel seal 60 along the angulated leg 60*b* of the seal 60.

A mounting bar 64 is fixedly secured to the perimeter of the diaphragm plate 14. The uppermost portion of the leg 60*a* of the Inconel seal 60 lies adjacent the peripherally outermost vertical surface of the bar 64. A spacer bar 66 is disposed against the peripherally outermost surface of the uppermost portion of the leg 60*a*, and the uppermost portion of the leaf spring 62 lies adjacent the peripherally outermost vertical surface of the spacer bar 66. A plurality of threaded bolts 68 secures leaf springs 62, spacer bar 66 and Inconel seal 60 against the mounting bar 64 which is tapped to receive the bolts 68. Of course, structure other than bar stock may be used for the mounting bar 64 and spacer bar 66, such as an angle structural section in conjunction with through bolts.

Referring now in particular to FIGS. 2–4, a plurality of spring plungers 72 are disposed around the periphery of the main frame 12, at approximately an eight inch spacing, and are fixedly secured to the end plates 22, 22 and side plates 24, 24 of the main frame 12 as by welding. Each spring plunger 72 includes a plunger housing 74 which houses an upper screw 76 which is separated from a lower plunger 80 via a compression spring 78. An upper plunger 76*a* rides atop compression spring 78 and below upper screw 76. Rotation of the screw 76 within the mateably threaded housing 74 causes the spring 78 to force lower plunger 80 downwardly. The lower plunger 80 of each spring plunger 72 contacts the upper surfaces of the mounting bar 64 and spacer bar 66 and seal 60 immediately beneath the plunger 76 and is operable to provide adjusting force to the seal 16, the adjustment of which will be subsequently described.

In use, the first or primary means of adjusting the coke oven door 10 to a door jamb 11 is via the turn buckle adjusting devices 34a, 34b and 34c in conjunction with the segmented flexible door mainframe 12. To force one or both of the upper and lower ends of the door 10 toward the jamb 11, one or both of the turnbuckles 40a and 40c must be utilized. For example, if the door 10 was leaking along its upper end, the upper end of door segment 10a can be forced toward the jamb 11 by turning the uppermost turnbuckles 40a and 40a so as to widen the gaps 32a, 32a in the side plates 22, 22. This forces the opposite (upper) end of upper door segment 10a toward the door jamb 11. Similarly, if the door 10 was leaking at its lower end, the lower end of segment 10d can be forced toward the jamb 11 by turning the lowermost turnbuckles 40c and 40c so as to widen the gaps 32c, 32c in the side plates 22, 22. Such adjustment of the turnbuckles 40a, 40a and 40c, 40c would result in a generally concavedly configured door, if viewed from the side.

To seal a leak occurring midway of the length of the door 10, the turnbuckles 40b, 40b must be shortened to narrow the gaps 32b, 32b in order to force the mid-portion of the door 10 against the jamb 11. Such adjustment of the turnbuckles 40b, 40b would result in a generally convexedly configured door, if viewed from the side.

While the turnbuckles are most often adjusted in pairs located directly across from each other, one on each side of the door body (FIG. 3), it is sometimes necessary to adjust only one turnbuckle in order to "twist" the door frame in order to achieve the proper door frame profile to seal properly with a jamb. Also many times two adjacent turnbuckles located on the same side of the door frame must be adjusted in unison in order to "relieve" one area while applying pressure to another.

Experience will aid in determining where door frame adjustment is needed and it will become apparent that the turnbuckles can be adjusted in any manner or sequence required in order to configure the door body, and therefore the seal, as may be necessary.

The second means of seal adjustment is the spring plungers 72 located above the seal 16 and at an approximately eight inch spacing around the entire perimeter of the door. If a localized leak is encountered which is located midway between two turnbuckles, it is possible to push the seal 16 toward the jamb 11 by increasing the pressure on the seal 16 between the turnbuckles via one or more for the plungers 72 located directly above the leak. Normally, if a leak is encountered which extends along the seal for more than sixteen to eighteen inches, the first consideration should be turnbuckle adjustment to the door frame.

Occasionally a leak will be found right at the corner of the door and it will, due to the inherent rigidity of the corners, be difficult, if not impossible, to seal by merely increasing spring plunger pressure. "Solid" plungers replace the spring plungers in such instance in order to provide greater pressure on the corners than would be available with the standard spring plungers.

The seal 16 in combination with both means of adjustment described above is operable to provide an effective seal between door 10 and jamb 11 The seal 60, contacting the jamb 11 at an angle, allows for greater elevational flexibility of the seal 16 than current door seals allow. Additionally, the angularly contacting seal provides for better penetration of the hard carbon which accumulates on the jamb sealing surface. The primary means of adjustment via the turnbuckles and flexible segmented mainframe allows the mainframe to be adjusted to a position of relative parallelism between the door body and the jamb seal surface of even a warped or distorted jamb. The secondary means of adjustment via the spring plungers allows for localized adjustment of the seal against the door jamb in the event that localized leaks occur.

Those skilled in the art will readily recognize numerous adaptations and modifications which can be made to the coke oven door of the present invention and which will result in an improved coke oven door, yet all of which will be encompassed by the spirit and scope of the invention as defined in the appended claims. Accordingly, I intend to be limited only by the claims and their equivalents.

What is claimed is:

1. A main frame adapted for use on a coke oven door comprising:

a planar base plate means;

a pair of end plates connected to said base plate means on either end thereof and being generally perpendicular to said base plate means;

a pair of side plates connected to said base plate means on either side thereof and being generally perpendicular to said base plate means;

each said side plate including a plurality of slots spaced along a lengthwise dimension of said side plate, each said slot extending from an edge of said side plate remote from said base plate means toward said base plate means only partially through said side plate, and adjusting means spanning each said slot and being operable to selectively increase or decrease a width dimension associated with said slot.

2. The mainframe of claim 1 wherein each said slot terminates at a relieved area which is substantially wider than a width dimension associated with said slot.

3. The mainframe of claim 1 wherein said adjusting means includes a pair of threaded studs, one of said pair being fixedly secured to said side plate on each side of said slot, and a threaded turnbuckle connecting said studs.

4. A coke oven door comprising:

a main frame;

a diaphragm plate mounted on said main frame; and a seal mounted peripherally of and to said diaphragm plate and adapted to be placed in contact with a door jamb to provide a seal therewith;

said main frame including a pair of generally parallel side plates spaced from one another transversely of a horizontal extent of said door, each said side plate including a plurality of slots spaced along a lengthwise dimension of said side plate, each said slot extending from an edge of said side plate remote from said diaphragm plate toward said diaphragm plate only partially through said side plate and being operable to provide flexibility to said main frame;

said main frame including adjusting means mounted to said side plates and spanning said slots and being operable to flex said main frame into a desired configuration.

5. The coke over door of claim 4 wherein said adjusting means comprises a pair of threaded studs, one of said pair being fixedly secured to said side plate on each side of said slot, and a threaded turnbuckle connecting said studs.

6. The coke over door of claim 4 further including plungers mounted peripherally of and to said mainframe and operable to apply adjusting force to said seal.

7. The coke over door of claim 4 wherein said seal is adapted for angular contact with a door jamb, and is backed by a plurality of individual leaf springs arranged in end-to-end relation which are operable to provide rigidity to said seal when said seal is in contact with a door jamb.

* * * * *

UNITED STATES PATENT AND TRADEMARK OFFICE

CERTIFICATE OF CORRECTION

PATENT NO. : 5,238,539

DATED : August 24, 1993

INVENTOR(S) : Billy C. Baird

It is certified that error appears in the above-identified patent and that said Letters Patent is hereby corrected as shown below:

Col. 6, line 55, "over" should be -- oven --.

Col. 6, line 60, "over" should be -- oven --.

Col. 6, line 63, "over" should be -- oven --.

Signed and Sealed this

Fourth Day of October, 1994

Bruce Lehman

*Attest:*

BRUCE LEHMAN

*Attesting Officer*

*Commissioner of Patents and Trademarks*